US010982474B2

(12) United States Patent
Alfredsson

(10) Patent No.: US 10,982,474 B2
(45) Date of Patent: Apr. 20, 2021

(54) ADJUSTABLE FITTING FOR A DOOR

(71) Applicant: Industrilås i Nässjö Aktiebolag, Nässjö (SE)

(72) Inventor: Bengt-Åke Alfredsson, Bodafors (SE)

(73) Assignee: Industrilås i Nässjö Aktiebolag, Nässjö (SE)

( * ) Notice: Subject to any disclaimer, the term of this patent is extended or adjusted under 35 U.S.C. 154(b) by 40 days.

(21) Appl. No.: 16/331,725

(22) PCT Filed: Sep. 14, 2017

(86) PCT No.: PCT/EP2017/073085
§ 371 (c)(1),
(2) Date: Mar. 8, 2019

(87) PCT Pub. No.: WO2018/050727
PCT Pub. Date: Mar. 22, 2018

(65) Prior Publication Data

US 2019/0203510 A1 Jul. 4, 2019

(30) Foreign Application Priority Data

Sep. 15, 2016 (EP) ..... 16188882

(51) Int. Cl.
*E05D 7/04* (2006.01)
*E05D 7/10* (2006.01)
*E05D 5/04* (2006.01)

(52) U.S. Cl.
CPC ..... *E05D 7/04* (2013.01); *E05D 7/1061* (2013.01); *E05D 5/04* (2013.01); *E05D 2007/0484* (2013.01)

(58) Field of Classification Search
CPC ..... E05D 7/04; E05D 7/1061
See application file for complete search history.

(56) References Cited

U.S. PATENT DOCUMENTS 4,819,298 A * 4/1989 Lautenschlager ..... E05D 11/06 16/237
5,283,929 A * 2/1994 Lin ..... E05D 7/04 16/237

(Continued)

FOREIGN PATENT DOCUMENTS

EP 0754831 A1 1/1997
WO 2006137102 A2 12/2006

OTHER PUBLICATIONS

International Search Report for International Application No. PCT/EP2017/073085, dated Nov. 22, 2017 (13 pages).
E-spacenet English Abstract of EP 0754831, (12 pages).

*Primary Examiner* — Jason W San
(74) *Attorney, Agent, or Firm* — Kagan Binder, PLLC

(57) ABSTRACT

The present disclosure relates to a fitting (1) for arrangement to a door and a door frame. The fitting (1) comprises a body (3), a first part (4), and a support plate (6) arranged at a door facing side of the body. The fitting is configured to abut the door when arranged thereto and comprises a distance element (5) in-between the support plate and the body which sets an offset between the support plate and the body. The distance element is moveable between different positions providing different offset between the body and the support plate. This arrangement minimizes the penetration of air or other substance through the door due to an offset between the door and door frame and can be used on different types of doors with different offsets.

13 Claims, 6 Drawing Sheets

(56) References Cited

U.S. PATENT DOCUMENTS

| | | | | |
|---|---|---|---|---|
| 5,603,142 | A * | 2/1997 | Dubach | E05D 7/0415 16/235 |
| 6,918,158 | B2 * | 7/2005 | Isele | E05D 7/0415 16/235 |
| 2004/0163213 | A1 * | 8/2004 | Isele | E05D 7/0423 16/245 |
| 2008/0016648 | A1 * | 1/2008 | Lautenschlager | E05D 7/0415 16/238 |
| 2009/0251039 | A1 * | 10/2009 | Muhlburger | E05D 7/04 312/405 |
| 2014/0082887 | A1 * | 3/2014 | Siekierka | E05D 7/04 16/237 |
| 2015/0292249 | A1 * | 10/2015 | Alfredsson | E05D 7/02 70/7 |
| 2015/0308172 | A1 * | 10/2015 | Veino | E05D 7/123 49/380 |
| 2015/0337577 | A1 * | 11/2015 | Peer | E05D 7/0415 312/326 |
| 2018/0044957 | A1 * | 2/2018 | Hoschler | E05D 7/1061 |
| 2018/0258675 | A1 * | 9/2018 | Rieboldt | E05D 7/1061 |
| 2019/0203510 | A1 * | 7/2019 | Alfredsson | E05D 7/1061 |

* cited by examiner

ADJUSTABLE FITTING FOR A DOOR

CROSS-REFERENCE TO RELATED APPLICATIONS

This application claims priority to International Application No. PCT/EP2017/073085, filed Sep. 14, 2017 and titled "ADJUSTABLE FITTING FOR A DOOR," which in turn claims priority from a European Application having serial number 16188882.1, filed Sep. 15, 2016, and titled "ADJUSTABLE FITTING FOR A DOOR," both or which are incorporated herein by reference in their entireties

TECHNICAL FIELD

The present disclosure relates to a fitting for a door, and especially to an arrangement related to the functional components of the fitting.

BACKGROUND

In the area of fittings for doors, a common configuration of the fitting comprises a first part fastened to a door frame and a body fastened on a door.

In this type of construction, it is sometimes desirable to minimize the penetration of air, gas, or other substance between the door and door's frame. A common way to minimize the penetration of air or other substance is by the body part abutting the door, pressing towards the door frame when the door is in closed position. Another way to minimize the penetration of air is by using a distance element such as that disclosed in EP0754831 A1.

A particular problem with this type of construction is the need for different fittings for different doors and frames with different offsets.

Therefore, there is a need for an improved fitting which can be used to minimize the penetration of air or other substance despite the offset between the door and frame.

SUMMARY

It is an object of the present invention to provide an improved solution that alleviates the mentioned drawbacks with present devices.

The invention is defined by the appended independent claims, with embodiments being set forth in the dependent claims, in the following description and in the attached drawings.

According to a first aspect of the invention, there is provided a fitting for arrangement to a door and a door frame, the fitting comprising a body, a first part configured to be arranged on a door frame, wherein the body is rotatably arranged to the first part, and a support plate arranged at a door facing side of the body and configured to abut the door when the fitting is arranged thereto. The fitting further comprises a distance element arranged in-between the support plate and the body and is moveable between at least a first position and a second position. The distance element provides, in the second position, an increased offset between the body and the support plate than in first position.

With this arrangement, the penetration of air or other substance can be minimized and one type fitting can be adapted to different types of doors with different offsets.

The support plate may abut the door and the force with which the door is pushed against the frame may be determined by the position of the distance element setting an offset between the support plate and the body. This may provide an offset between the fitting's attachment to the door and its attachment to the door frame. When closing the door, such offset may provide an increased pressure and tighter sealing between the door and the door frame compared to a fitting without offset.

The offset needed to achieve the desired pressure and sealing between the door and the door frame may vary and the distance element's position may be used to achieve this. As the distance element is moveable between the different portions the offset may be easily adjusted.

The present invention may be used in different kinds of fittings for doors, such as hinges, latches, handles and catches. In such embodiments, the body may be engageable with the first part by e.g. being rotatably arranged to the first part, lockable to the first part or otherwise engageable with the first part. The first part may further in such embodiments be e.g. a hinge part (such as a hinge pin part) or a striker engageable with the body of a latch, handle or catch.

In one embodiment, the distance element may be configured to offset the support plate and the body by setting a distance between the support plate and the body. The distance between the body and the support plate may be adjusted by moving the distance element between the first and second position. The offset and thereby the compression of the door to the door frame may be adjusted.

In another embodiment, the distance element may comprise at least a first and a second portion having different thickness, wherein the thickness of the first portion may set the distance between the support plate and the body when the distance element is in the first position, and the thickness of the second portion may set said distance when the distance element is in the second position. When less offset between the support plate and body is desired, a less thick portion of the distance element may be used and when a larger offset between the support plate and body is desired, a thicker portion of the distance element may be used. By moving the distance element between the first and the second position, different portions of the distance element may affect the offset between the body and the support plate.

In one embodiment, the distance element may further comprise a means for moving the distance element between the at least first and second positions. The moving means may protrude through the body such as to be accessible despite the distance element location in-between the support plate and the body. The different positions of the distance element may be used to adjust the distance between the support plate and the body. A thicker thickness of the distance element may push the support element away from the body towards a door and thus adjusting the fitting to allow it to be used on any door with different offsets between the door and door frame.

In one embodiment, the distance element may be movable by rotation. The distance element may be of a circle sectional shape and rotation of the distance element may allow for the distance element to be rotated from one position to another. Alternatively, the distance element may take rectangular shape or other shape suitable for thickness variation. The movement of the distance element between its different positions may be performed by moving the distance element for example by a linear movement.

The distance element may in a further embodiment be rotatable around the means for moving. Rotation of the distance element may be around the means for moving and may facilitate the action of shifting position of the distance element. A through hole for an axis of rotation may also occupy a limited amount of space on the body. The means for moving may comprise an adjustment screw. The distance element may be rotatable around the rotational axis of the adjustment screw. The adjustment screw may comprise a socket head cap screw, a screw head, a nut, or other means for rotation. The adjustment screw may be an integrated part of the distance element. Alternatively, the distance element may be linearly moveable and the means for moving may provide such linear movement.

In one embodiment, the distance element may be fixed by fastening means to the body and the support plate in any of the at least first or second position. Fixation of the distance element into a position may assure that the distance element does not move out of position and thereby changes the offset of the support plate relative the body unintentionally. The fastening means may be loosened such as to rotate the distance element to another position, for example to adjust to a different offset between a door and door frame, and the distance element may then be fixed in the new position.

The fastening means fixating the distance element into a first or second position may in one embodiment comprise a screw. The fastening means may be fixed from the body, through the distance element and into the support plate to secure the position of the distance element relative the support plate and/or the body. Alternatively, the fastening means may be fixed through the body, distance element, support plate, and into the door.

In one embodiment, the support plate may comprise a contacting part configured to protrude from the support plate and to abut the distance element in any of the at least first and second portions. The contacting part may serve as a point of contact between the support plate and the distance element to allow for a stable construction. The contacting part may abut the distance element in any position of the distance element. The contacting part may have a shape at least partly corresponding to the shape of the portions of the distance element. Such correspondence may provide a rigid contact between the two parts. The contacting part may be of a circle sectional shape and the angle of the sides of the shape may correspond to the angle of at least one of the sides of the portions of the distance element.

Further, in one embodiment, the support plate may comprise a first area and a second area, wherein the distance element is arranged in-between the body and the support plate at the first area of the support plate, wherein the second area of the support plate is in contact with the body. One area of the support plate in contact with the body may allow for the body and support element to be fixed to each other to enhance stability of the construction. The first area of the support plate in contact with the distance element, and the distance element being located in-between the body and the support plate may allow for the support plate, the distance element, and the body to be fixed to each other by using only one means of fixation, such as a screw. Additional fixation means may be provided in the second area of the support plate. The first area of the support plate may be fixed to the door directly or jointly fixed to the door and the body and/or the distance element. The second area of the support plate may be fixed to the door directly or jointly fixed to the door and the body. The first area of the support plate may be located closer to a door frame portion of the fitting than the second area, the door frame portion configured to be arranged to a door frame.

In one embodiment, a protruding surface configured to maximize the contact region between the body and the second area of the support plate may be arranged on the body or on the support plate.

As the distance element is moved to a position with a larger thickness, the support element is offset from the body, a protruding surface may serve to assure contact is maintained between the support plate and the body. The protruding surface may be located either on the support plate facing side of the body or on the body facing side of the support plate. The protruding surface may be located at the second area of the support plate. Fastening means may be configured to be arranged through the protruding surface to attach the body to the support plate.

In one embodiment, the protruding surface may have a cross-sectional form of a circle segment extending above the surface of the body or the support plate. A circle segmental form of the protruding surface may maximize the area of contact between the support plate and the body for any offset of the support plate relative the body. The offset of the support plate as the thickness elements distance increases may be a rotational movement. The axis of rotation may be around the highest point of the circle segment of the protruding surface. Due to the protruding surface's extension above the surface of the body or the support element, the axis of rotation is moved from an end edge of the support plate to a surface of the protruding surface. The area of contact between the support plate and the body is thereby maximized regardless of the distance between the support plate and the body set by the distance element.

In one embodiment, the body and the support plate may be configured to be fastened by use of fastening means to each other and/or a door. The support plate may be fastened to the body via the distance element and additionally the body and support plate may be fastened to each other by for example screws. The body and/or the support plate may further be fasted to a door by for example screws to assure a fixed position on the door.

In one embodiment, at least one fastening means is intended to extend through the protruding surface. The support plate may be fixed to the body by a fastening means such as a screw to assure that these are fixed to one another and no relative movement between these affect the support element's abutment of the door. The location for fastening may be through the protruding surface.

In one embodiment, a door facing side of the body may comprises a plane A wherein the support plate comprises a lower surface placed in plane A in at least one of the positions of the distance element and wherein the lower surface of the support plate is offset from said plane in at least one other position of the distance element. The offset of the support plate in relation to the body may be used to adjust the fitting to be compatible to different doors with different offsets between the door and the door frame. As the support plate is offset and extends through the plane A, the support plate abuts the door and further presses it against the door frame to minimize the flow of air or gas through the door and door frame. The first part of the fitting, configured to be attached to the door frame, may be coupled to the body. An offset of the support plate relative to the body may thereby provide an offset of the support plate relative to the first part and an offset of the fitting's attachment to the door relative to its attachment to the door frame.

In one embodiment, the fitting may be a hinge, the first part may be a hinge part configured to be arranged on a door frame, and the body may be rotatably arranged to the first part.

In one embodiment, the hinge may be a latching hinge and the latching hinge may comprise a handle which is rotatably arranged to the body such that the body may be released from the hinge part when the handle is in an unlatched position.

BRIEF DESCRIPTION OF THE DRAWINGS

This and other aspects of the present invention now be described more in detail, with reference to the appended drawings showing a currently preferred embodiment of the invention.

DETAILED DESCRIPTION

Figure 1:
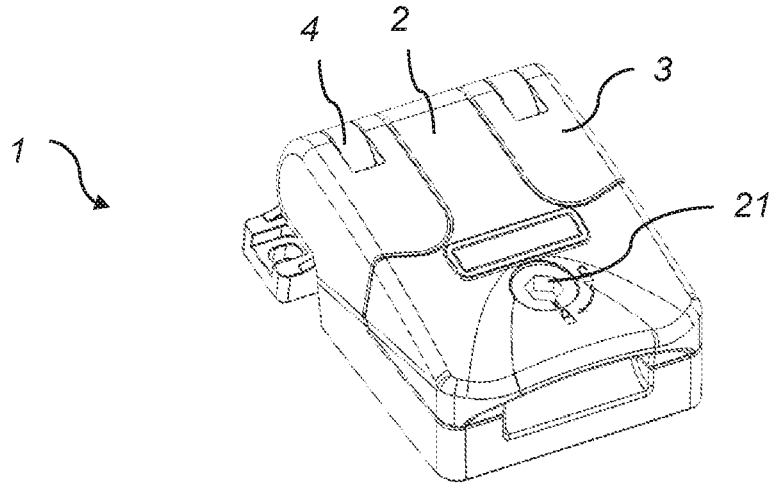
FIG. 1 shows a perspective view of a fitting according to an embodiment of the invention.

The present invention will be described more fully hereinafter with reference to the accompanying drawings. In the drawings, like numbers refer to like elements.

The present invention is defined by the appended independent claim, and is in the following description and figures illustrated and described with reference to a latching hinge 1 according to an embodiment of the invention.

The latching hinge 1 according to an embodiment of the invention is illustrated in FIG. 1. The latching hinge is shown in latched position with the handle 2 rotated into contact with the body 3. A locking element 21 may be rotated to lock the handle 2 in latched position. In latched position, the latching hinge 1 has the function of a hinge, wherein the body 3 and handle 2 are rotatable relative to the hinge part 4.

Figure 2:
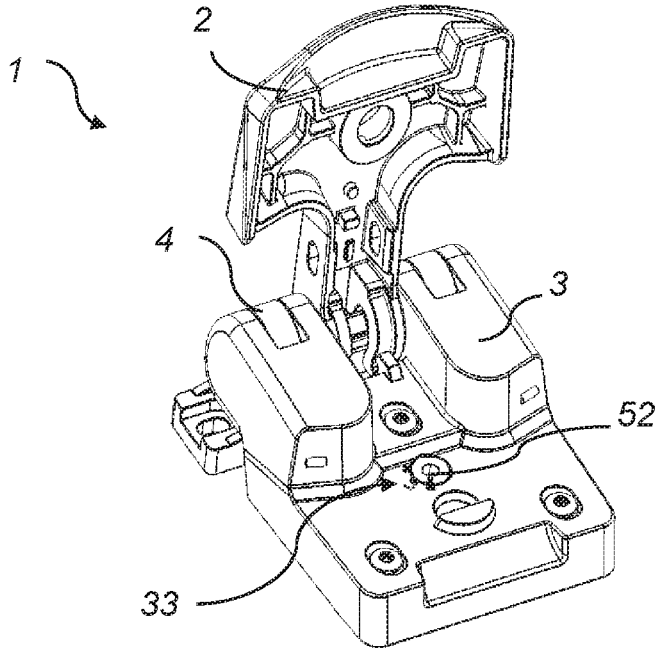
FIG. 2 shows a perspective view of a fitting in unlatched position according to an embodiment of the invention.

In FIG. 2, the latching hinge 1 is show in unlatched position with the handle 2 rotated away from the body 3, allowing the body 3 to be released from the hinge part 4. In the unlatched position of the handle 2, the latching hinge 1 is openable as a latch for the door to a door frame.

Figure 3:
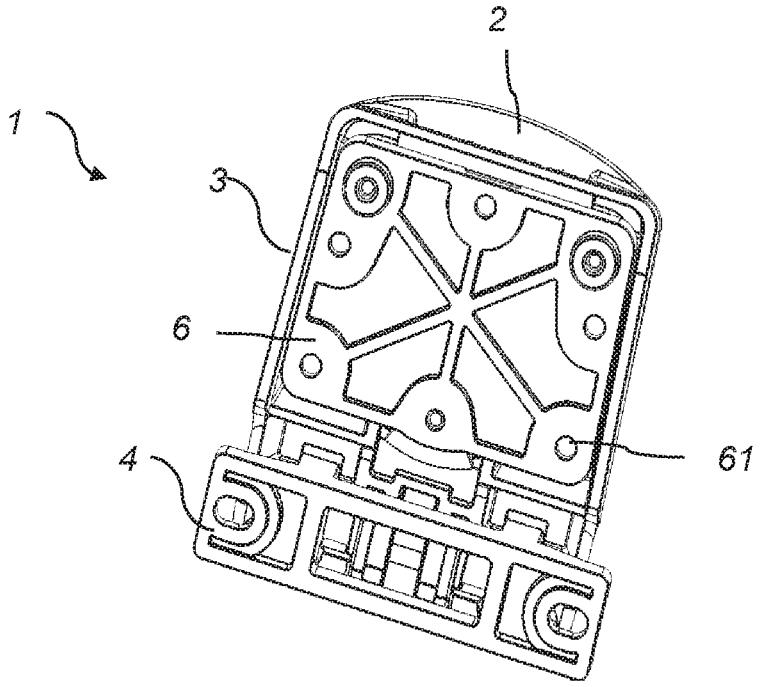
FIG. 3 shows a bottom view of a fitting according to an embodiment of the invention.

FIG. 3 shows a door facing side of the latching hinge 1. A support plate 6 is attached to the body 3 through holes 61 via fastening means such as screws. The body 3 and support plate 6 are configured to abut a door. The hinge 4 is configured to be arranged to a door frame.

Figure 4A:
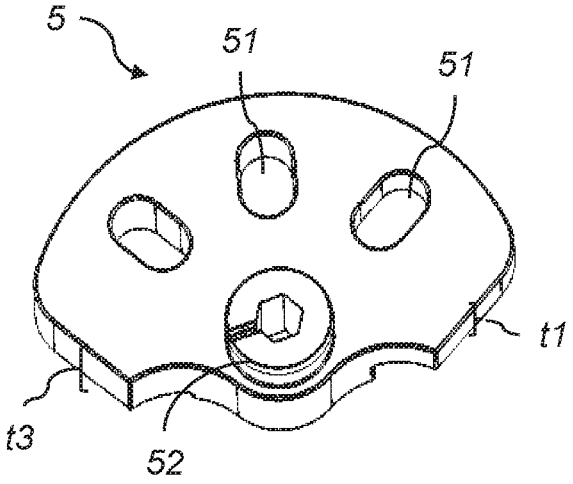
FIGS. 4*a* and 4*b* each shows a perspective view of a distance element according to an embodiment of the invention.

An example of a body facing side of a distance element 5 according to the invention is shown in FIG. 4*a*. The distance element 5 is arranged between the body 3 and the support plate 6. The distance element 5 comprises at least one hole 51 for fastening the distance element 5 to the support plate 6 and the body 3. Fastening may be done by for example use of a screw or other fastening means.

The thickness t varies across the distance element 5, with a first portion p1 having a thickness t1 which may be less than a thickness t2 of a second portion p2. The thickness t2 is further smaller than a thickness t3 of a third portion p3 of the distance element 5.

The distance element 5 further comprises a setting screw head 52 for moving the distance element 5 between different positions of the distance element. The setting screw head 52 may be a socket head cap screw, a screw head, a nut, or other means for rotation. The setting screw head 52 protrudes through the body 3 such that the distance element 5 can be moved or rotated without exposing the body facing side of the distance element 5, as illustrated in FIG. 2. The distance may be elected using marks 33 on the body, indicating the position or thickness of the current position of the distance element, also indicated in FIG. 2.

The different thicknesses t1, t2, t3 set the distance between the support plate 6 and the body 3. The distance element 5 may be moved between the positions by rotation or by a linear motion. The distance element is in the illustrated embodiment moved by rotation around the setting screw head 52. The position of the distance element may alternatively be shifted by for example linear vertical or horizontal movement of the distance element.

The distance element 5 may further be of a circular or circle sectional shape or of any other shape, such as a rectangular shape comprising different thicknesses in different portions of the element.

Figure 4B:
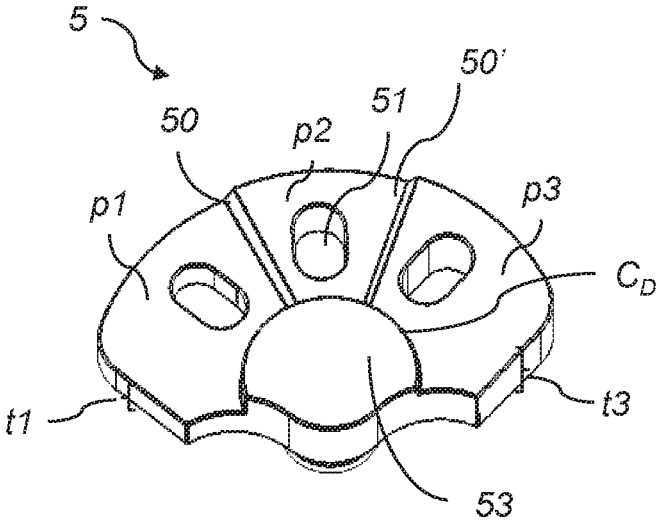

In FIG. 4*b* the support plate facing side of the distance element 5 is shown. The distance element 5 comprises portions p1, p2, p3 of different thicknesses t1, t2, t3, and is moveable between different positions when arranged in the latching hinge 1. Between each portion p1, p2, p3 and an adjacent portion p1, p2, p3 there is a side edge 50, 50'. The side edges 50, 50' provide the change of thickness between the portions p1, p2, p3. The side edges 50, 50' are inclined towards the connecting portions p1, p2, p3. The distance element 5 further comprises a protrusion 53. The protruding surface 53 is at least partly circularly shaped, and has a curvature $C_D$ facing the portions p1, p2, p3. The protrusion 53 extends to have a thickness larger than the thickness t3 of the third portion p3.

Figure 5A:
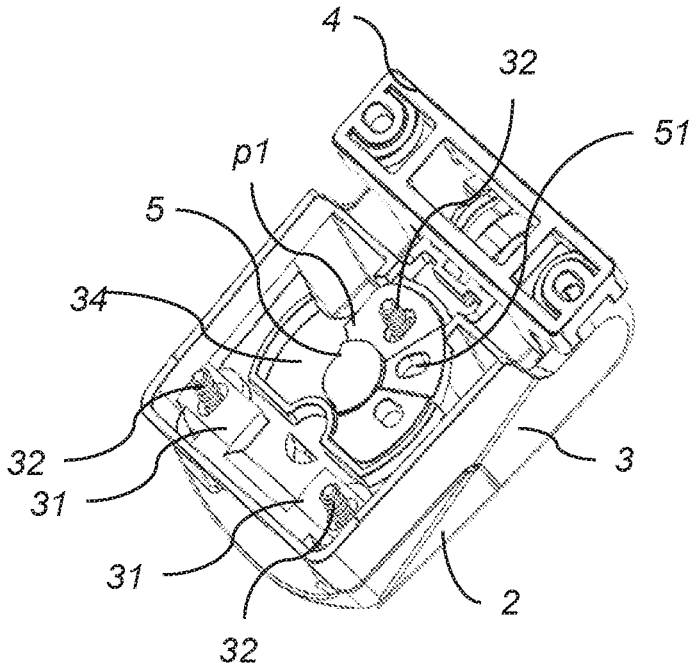
FIG. 5*a* shows an exploded view of a fitting with the distance element in a first position according to an embodiment of the invention.

FIG. 5*a* shows the distance element 5 in a first position where the first portion p1 with thickness t1 is fixed by screws 32 via the holes 51 to the body 1 and sets the distance between the body 1 and the support plate 6 (not shown). FIG. 5*a* further illustrates the protruding parts 31, which may serve as to maximize the contact area between the support plate 6 and the body 3. The support plate 6 and the body 3 may be fixed to each other by screws 32. The means 32 fastening the body 3 and the support plate 6 to each other may extend through a protruding part 31.

The protruding part 31 has a longitudinal extension and is positioned either on the support plate 6 or as illustrated on the body 3. The protruding part 31 has a circle segment profile to maximize the contact area as the support plate 6 and body 3 are rotated away from each other. The distance element 5 is positioned in a cavity 34 of the body 3 such that when the distance element 5 is positioned in a position with the thinnest portion p1 in contact with the support plate 6, the support plate 6 is in contact with the body 3 at the area next of the distance element. In such situation, the distance element 5 has no effect on the positioning of the support plate 6 relative to the body 3.

Figure 5B:
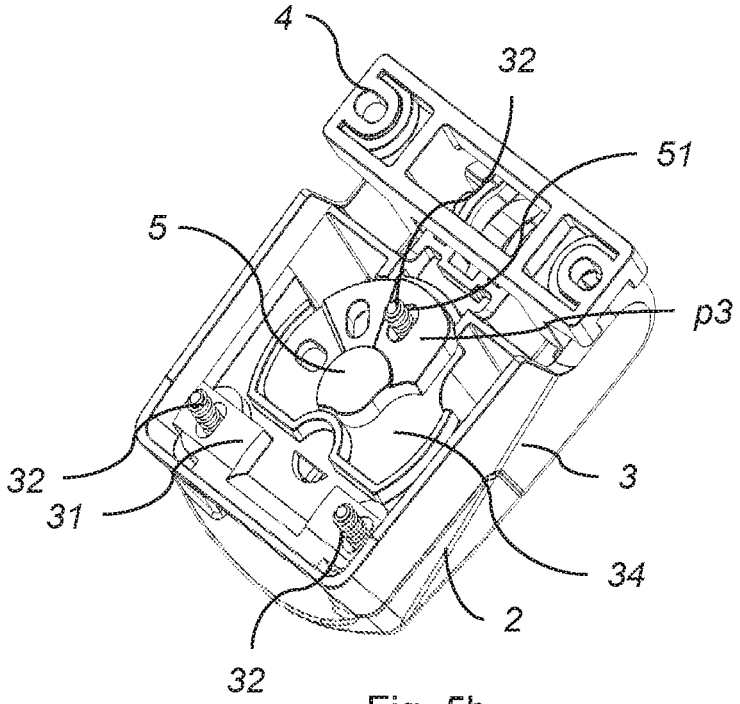
FIG. 5*b* shows an exploded view of a fitting with the distance element in a second position according to an embodiment of the invention.

FIG. 5*b* shows the distance element 5 in a third position where the third portion p3 sets the distance between the body 3 and the support plate 6 to a different distance than that of p1, illustrated in FIG. 5*a*. The distance element 5 is fixed in said third position by screw 32 via the holes 51 to the body 1. In the same manner, in a second position, not shown, a second portion p2 having a thickness t2 sets the distance between the body 1 and the support plate 6.

Figure 6:
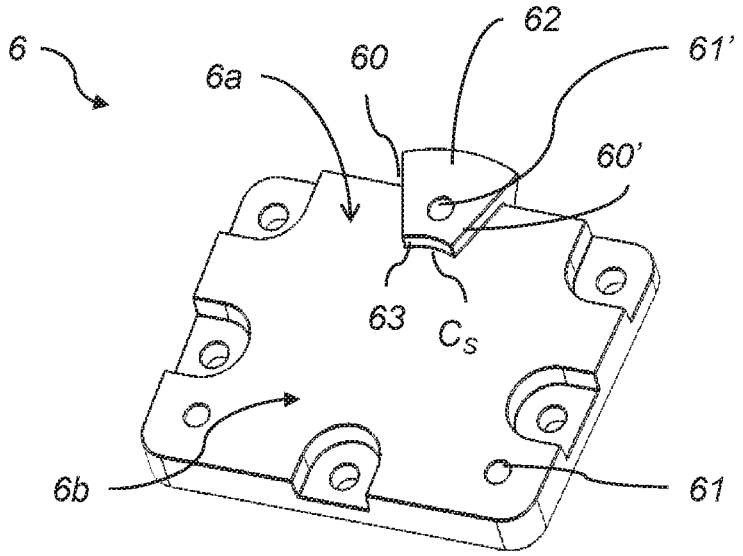
FIG. 6 shows a perspective view of a support plate according to an embodiment of the invention.

The support plate 6 is illustrated in FIG. 6. The support plate 6 comprises a contacting part 62 which abuts the distance element 5 as to create an area of contact there between regardless the current position of the distance element 5. The contact part 62 is in contact with the portion p1, p2, p3 that currently is in a distance setting position (as p1 in FIG. 5*a*). The portions p1, p2, p3 of the distance element 5 are divided as segments of the distance element 5. At least one of the sides 50, 50' of each portion p1, p2, p3 extends in a corresponding angle as the sides 60, 60' of the contacting part 62. The sides 50,50' of the distance element 5 and the angle corresponding sides 60, 60' of the contacting part 62 aid in holding the distance element 5 in a fixed position relative the support plate 6 in certain of the distance element's 5 positions p1, p2, p3 when the sides of the different parts are in contact with each other.

The distance element 5 has a protrusion 53 (see FIG. 4*b*) extending above the portions p1, p2, p3 and facing the support plate 6. The protrusion 53 has a curvature $C_D$ corresponding to the curvature $C_S$ of the contacting part such that the side of the protrusion 53 of the distance element and the side 63 of the contacting part provide an area of contact between the support plate and the distance element 5. This area of contact aids in guiding the distance element 5 in the correct position with respect to the support element 6 during rotation of the distance element 5.

Further, the support plate 6 comprises holes 61 screws 32 to attach to the body 3 and a hole 61' for fixation to the body 3 via the distance element 5. The support plate 6 comprises a first area 6*a* and a second area 6*b*. The first area 6*a* may be in contact with the body 3 for a certain thickness of the distance element 5 and tilted away from the body 3 when the thickness t of the distance element 5 increases. The second area 6*b* of the support plate 6 is always in contact with the body 3.

Figure 7:
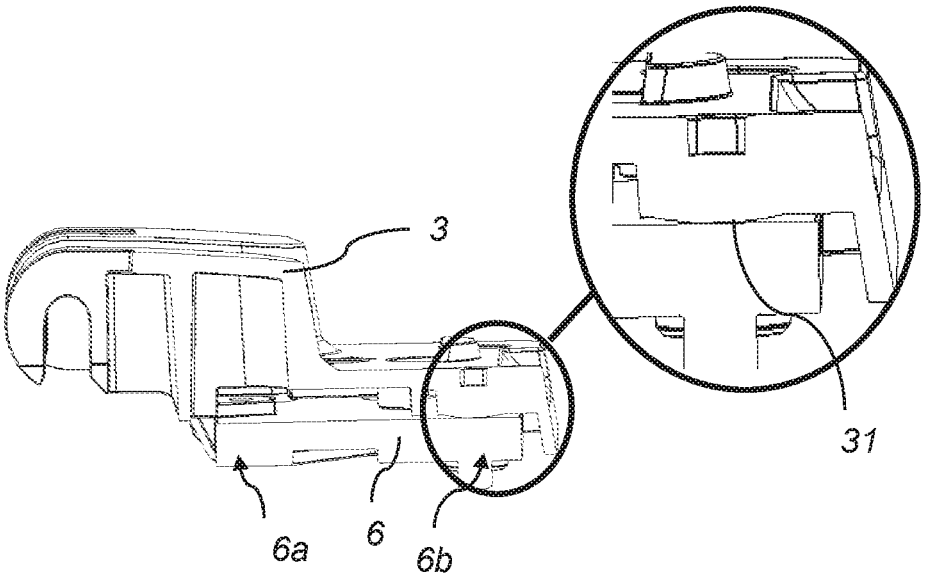
FIG. 7 shows a cross-section of a body and support plate of a fitting according to an embodiment of the invention.

A cross-section of the latching hinge 1 is illustrated in FIG. 7. The body 3 comprises a protruding surface 31 such as to create a contact surface to the support plate 6 when the support plate 6 is distanced from the body 3 by the distance element 5 (see FIG. 8*b*). The protruding surface 31 has a cross-sectional form of a circle segment extending above the surrounding surface of the body 3. When the support plate 6 is distanced from the body 3 at the location of the distance element 5, the support plate 6 will be rotated around a point on the protruding surface 31. A connection between the body 3 and the support plate 5 can thereby be withheld at the same place, i.e. by means of fastening means extending through the protruding surface 31.

Figure 8A:
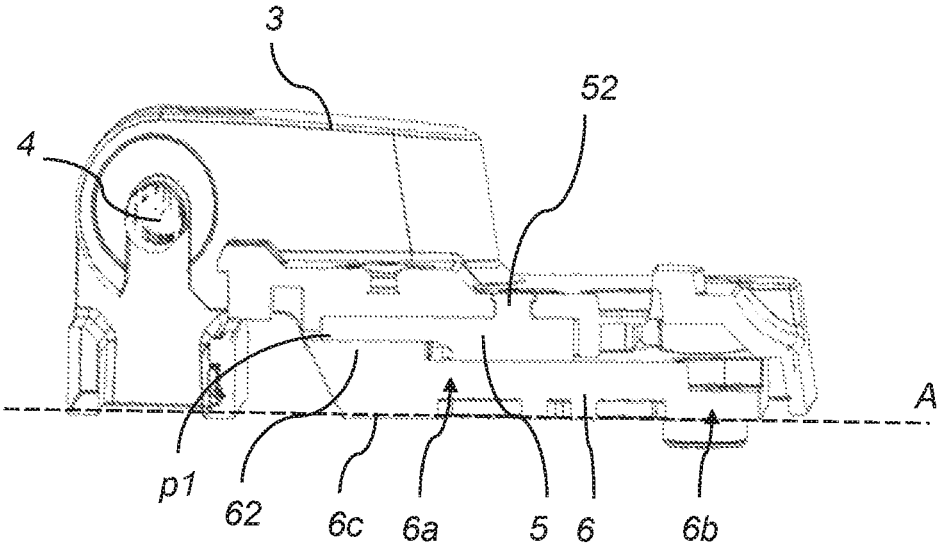
FIGS. 8*a* and 8*b* show a cross-section of a fitting according to an embodiment of the invention.
Figure 8B:
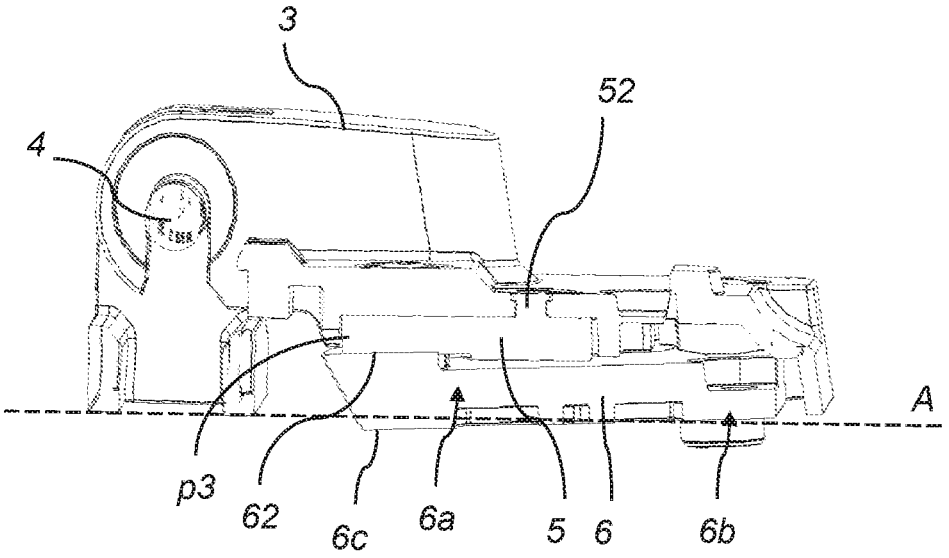

In FIG. 8*a* a cross-section of the body 3, the support plate 6, and the distance element 5 of the latching hinge 1 are shown. The distance element 5 is shown with a portion p1 of thickness t1 setting the distance between the support plate 6 and the body 3. In a certain position a lower surface 6*c* of the support plate 6 lies in a plane A suspended by a door facing side of the body 3. Using the means 52 for moving the distance element 5 to a position p2, p3 with a thickness t2, t3 thicker than t1, will cause the first area 6*a* of the support plate to tilt away from the body 3 through the plane A, as illustrated in FIG. 8*b*, such that the lower surface 6*c* of the support plate 6 is offset in relation to plane A.

The latching hinge 1 may be produced from plastics, metal, a combination of these of other suitable material and may be produced in separate parts for example by injection molding.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. An external hinge (1) for arrangement to a door and a door frame, the hinge comprising a body (3) configured to be arranged externally to a door, wherein the door contacts a door frame when in a closed position, a hinge part (4) configured to be arranged externally on the door frame, wherein the body (3) is rotatably arranged to the hinge part (4), and a support plate (6) arranged at a door facing side of the body (3) and configured to abut the door when the hinge is arranged thereto, wherein the hinge (1) further comprises a distance element (5) arranged in-between the support plate (6) and the body (3), the distance element having a circle sectional stepped shape and comprising at least a first and a second portion having different thickness, wherein the thickness of the first portion sets the distance between the support plate and the body when the distance element is in the first position, and the thickness of the second portion sets the distance when the distance element is in the second position, the distance element being moveable by rotation between at least the first position and the second position, wherein the distance element in the second position provides an increased offset between the body and the support plate than in the first position to provide an increased pressure between the door and the door frame to in turn provide tighter sealing between the door and the door frame when the door is in the closed position compared to a with different offsets from the door frame.

2. An external hinge (1) according to claim 1, wherein said distance element (5) further comprises a means for moving (52) the distance element between the at least first and second positions.

3. An external hinge (1) according to claim 2, wherein the distance element (5) is rotatable around the means for moving (52).

4. An external hinge (1) according to claim 1, wherein the distance element (5) can be fixed by fastening means (32) to the body and the support plate (6) in any of the at least first or second position.

5. An external hinge (1) according to claim 4, wherein the fastening means (32) fixating the distance element (5) into a first or second position comprises a screw.

6. An external hinge (1) according to claim 1, wherein the support plate (6) comprises a contacting part (62) configured to protrude from the support plate and to abut the distance element (5) at any of the at least first and second portions.

7. An external hinge (1) according to claim 1, wherein said support plate (6) comprises a first area (6*a*) and a second area (6*b*) and wherein the distance element (5) is arranged in-between the body (3) and the support plate at the first area of the support plate, wherein the second area of the support plate is in contact with the body.

8. An external hinge (1) according to claim 7, wherein a protruding surface (31) configured to maximize the contact region between the body (3) and the second area (6*b*) of the support plate (6) is arranged on the body or on the support plate.

9. An external hinge (1) according to claim 8, wherein the protruding surface (31) has a cross-sectional form of a circle segment extending above the surface of the body (3) or the support plate (6).

10. An external hinge (1) according to claim 1, wherein the body (3) and the support plate (6) are configured to be fastened by use of fastening means (32) to each other and/or a door.

11. An external hinge (1) according to claim 8, wherein the body (3) and the support plate (6) are configured to be fastened by use of fastening means (32) to each other and/or a door, and wherein at least one fastening means (32) is intended to extend through the protruding surface (31).

12. An external hinge (1) according to claim 1, wherein a door facing side of the body (3) comprises a plane (A) and wherein the support plate (6) comprises a lower surface (6*c*) placed in the plane in at least one of the positions of the distance element (5) and wherein the lower surface of the support plate is offset from said plane in at least one other position of the distance element.

13. An external hinge (1) according to claim 1, wherein the hinge is a latching hinge and wherein the latching hinge comprises a handle (2) rotatably arranged to the body (3) such that the body is released from the hinge part (4) when the handle is in an unlatched position.

* * * * *